US005515029A

United States Patent [19]

Zhevelev et al.

[11] Patent Number: 5,515,029

[45] Date of Patent: May 7, 1996

[54] GLASS BREAKAGE DETECTOR

[75] Inventors: Boris Zhevelev, Rishon Lezion; Mark Moldavsky, Tel Aviv; Nahum Tchernihovsky, Ramat Hasharon, all of Israel

[73] Assignee: Visonic Ltd., Tel Avis, Israel

[21] Appl. No.: 175,323

[22] Filed: Dec. 29, 1993

[30] Foreign Application Priority Data

Dec. 1, 1993 [IL] Israel ..... 107834

[51] Int. Cl.[6] ..... G08B 13/20

[52] U.S. Cl. ..... 340/544; 340/540; 340/556

[58] Field of Search ..... 340/544, 540, 340/550, 566, 522

[56] References Cited

U.S. PATENT DOCUMENTS

| | | | |
|---|---|---|---|
| 3,863,250 | 1/1975 | McCluskey, Jr. | 340/274 |
| 3,889,250 | 6/1975 | Solomon | 340/540 |
| 4,091,660 | 5/1978 | Yanagi | 340/550 |
| 4,134,109 | 1/1979 | McCormick et al. | 340/550 |
| 4,668,941 | 5/1987 | Davenport et al. | 340/550 |
| 4,837,558 | 6/1989 | Abel et al. | 340/550 |
| 4,853,677 | 8/1989 | Yarbrough et al. | 340/554 |
| 5,117,220 | 5/1992 | Marino | 340/550 |
| 5,192,931 | 3/1993 | Smith | 340/550 |

*Primary Examiner*—John K. Peng
*Assistant Examiner*—Albert K. Wong
*Attorney, Agent, or Firm*—Woodcock, Washburn, Kurtz, Mackiewicz & Norris

[57] ABSTRACT

A method of detecting glass breakage utilizing the sound produced by an event comprising the steps of sensing the sound and producing an electrical signal characteristic of the sound, producing a plurality of frequency band-limited signals from the sound signal, determining when a normalized rate-of-rise of a plurality of the band limited signals is above a given value specified for the particular band-limited signal and analyzing the sound signal further only if a plurality of the band-limited signals have a normalized rate-of-rise greater than their respective given value during a specified time period.

24 Claims, 8 Drawing Sheets

TAIL CONDITION COMPUTATION AND TEST

GLASS BREAKAGE DETECTOR

FIELD OF THE INVENTION

This invention relates to the field of intrusion detectors and more specifically to the field of glass breakage detectors based on the sound of breaking glass.

BACKGROUND OF THE DETECTORS

A wide array of intrusion detectors are known in the art. Some of these detect the presence of an intruder in a particular area and others detect intrusions into the area, or attempts to break into the area. One type of intrusion detector for determining break-in is a glass breakage detector.

One type of glass breakage detector analyzes sounds picked up by a microphone to determine if they are produced by breaking glass. A foolproof determination of glass breakage by acoustic means is extremely complicated since many factors must be taken into account in order to avoid both false positives, where the alarm sounds when there is no break-in, and false negatives in which true glass breakage is not detected by the system.

U.S. Pat. No. 3,863,250 to McClusky, Jr. describes a glass breakage detector which is directly mounted on a sheet of glass whose breakage is to be detected. The detector comprises a sensor mounted on layers of material which attenuate acoustic frequencies which are not characteristic of the shock of breaking glass.

U.S. Pat. No. 4,134,109 to McCormick et al. comprises a signal analysis circuit which utilizes a sound having an intensity above a given threshold level to start the detection process. The system waits a predetermined interval and then determines if the integrated signal at a majority of a plurality of frequencies characteristic of falling glass is above a threshold during a pre-set time window starting after the interval. If the threshold condition is met and the sound at these frequencies ceases by a pre-set time, an alarm is sounded.

U.S. Pat. No. 4,668,941 to Davenport et al. describes a glass breakage detection system that utilizes the frequency components of the thump of glass breakage at about 350 Hz and the tinkle of breaking glass caused by collision of glass fragments at about 6.5 kHz. A very low frequency signal triggers a time delay of about 200 milliseconds and establishes a time window which closes at 800 milliseconds or one second. An alarm is sounded if there is a high frequency signal greater than a threshold value during the time window. In order to avoid false alarms such as may be caused by tapping on the window, a particular frequency to voltage convertor is used to exclude all frequencies below 4.5 kHz.

U.S. Pat. No. 4,837,558 to Abel et al. describes a tuned unidirectional glass breakage detector responsive to sounds in the 4 to 8 kHz range.

U.S. Pat. No. 4,853,677 to Yarbrough et al. describes a glass breakage detector which detects sounds at 3kHz to 4kHz to determine if there has been glass breakage. The detector also includes a door or window opening detector which detects pressure changes at 1–2 Hz. The sensitivity of the glass breakage detector is increased in the presence of low frequency signals since the combination is said by the patent to indicate a break-in wherein steps have been taken to minimize breaking glass sounds.

None of the above prior art devices is sufficiently effective in determining glass breakage for certain types of glass such as safety or laminated glass. Furthermore, the analysis of sounds provided by these devices is not capable of determining glass breakage for a variety of glass types while also having a low false alarm rate.

SUMMARY OF THE INVENTION

The present invention seeks to provide a glass breakage detector having a low false alarm rate and a high sensitivity to true glass breakage events.

In general, the glass breakage detector of the invention receives signals during four time periods and utilizes certain characteristics of the acoustic energy (sound) in these time periods to determine if an event represents breaking glass.

During a first time period the detector determines if a sound pattern may be caused by a glass breakage event and should be further analyzed. This determination is sometimes referred to herein as the "start" condition.

During a second time period the sound is characteristic of impact on and breaking of the glass and the immediate aftermath of the breaking. Generally, the sound caused by glass breaking is different than that for events in which the glass doesn't break. Most of the sound energy of an actual breakage is produced during this second time period.

During a third time period, which commences after the conclusion of the first period but which generally includes at least part of the time frame during which sounds of breaking are produced, certain events are rejected based on the characteristics of non-breaking events and certain events are immediately determined to be glass breakage events without further testing.

Finally, during a fourth time period, the effects of falling glass are evident and the sound energy produced by the falling glass can be used conclusively to characterize an event which was not previously characterized as a glass breakage event or a nonbreakage event.

In one aspect of the present invention, measurement and analysis of sound waves in three frequency ranges are used in concert to remove false alarms and to validate true glass breakage events. Various characteristics of the sound in the three frequency ranges (designated herein as high, mid and low frequencies) are used to determine the authenticity of a breakage event. Each of these three frequency ranges is characteristic of one or more aspects of impact on glass or glass breakage. A variety of measurements and comparisons are performed on the various signals, their integrals and derivatives either to validate an event or to exclude an event as a false alarm.

This aspect of the invention finds a number of expressions in practice:

(1) In one expression of this aspect of the invention the determination process begins only if the rate of rise of the audio signals in two and preferably all three frequency ranges meets specified criteria within a specified time frame, before the determination procedure. Preferably the process begins when measurement shows that the last of the required signals meets its rate of rise requirement (the start condition). Preferably, if the low frequency meets its criteria before the high and mid ranges, then the determination process does not begin, since this sequence is characteristic of a door slamming and not of breaking glass.

(2) In a second expression of the first aspect, the time extent of at least one first burst of energy at one of the frequencies, preferably the high frequency, is measured to exclude non-breakage events and to reset the system. In this expression, the signal after a predetermined time (for example, the end of the second period) is compared to the peak signal during the first burst of energy and processing is continued only if the ratio is higher than a predetermined value. This time extent can be measured, for example, by measuring the value of the signal at the end of the second period and comparing this value with the peak value of the signal during the second period.

If the value of the signal at the end of the second period is too low, the event was not caused by glass breakage and is most likely caused by other events such as hand clapping or a hammer.

Alternatively or additionally, the low frequency signal is separately integrated during the second and third time periods to determine a measure of the energy during these periods. The amount of energy in the two periods is compared and processing is continued only if the integral in the second period is greater than that in the third period but not more than a preset multiple times the integral in the second period.

A comparatively large low-band energy in the third time period is characteristic of an unbroken vibrating glass sheet and not of breakage. This effect is especially pronounced if the glass sheet is large. On the other hand, too small an energy in the third period shows that the event was not connected to impact on the glass at all, but may have been caused by a hammer or a hand clap.

(3) In a third expression of this aspect, the ratio of the peak values of the high and mid frequency signals in the second period is compared. If the ratio between the two signals is within a given range, then the determination process is continued; otherwise it is terminated.

(4) In a fourth expression of this aspect, a measure of the energy in the high-band, which is inter alia characteristic of falling glass, is determined during a later period (the fourth period) after the first burst of energy. If the fourth period high-band energy is greater than a given percentage of the second period high-band energy, the event is validated.

In a second aspect of the invention, at least some of the characteristics and ratios (collectively "measures") of the sounds are measured against two different criteria. If the measure is within a narrow range, then the event is validated as glass breakage. If the measure is within a wider range, the event is not validated but is subject to additional testing to determine if it is a glass breakage event. If the event is outside the wider range, it is determined not to be a glass breakage event and the process is terminated.

An important expression of this aspect of the invention is that if the ratio of the low-band energies during the second and third time periods is within a preset narrow range, then the event is accepted without any additional testing during the fourth time period for falling glass. If the ratio is within a wider range, testing is continued to determine if there is falling glass as described under (4) above. If the event is outside this wider range, the event is determined not to be a glass breakage event and the system is reset.

Generally speaking, sound energy produced by falling glass is present almost completely in the high-band. In order to improve the accuracy of the system, high-band energy is measured by integrating the high band energy minus the previous low value of the energy. If the resulting value is negative, the integral is not taken. This method of calculation tends to isolate the effect of falling of particular pieces of glass.

In a further preferred embodiment of the invention, a correlation between sounds in the high and mid-bands is performed during the fourth period. If the sounds correspond (measured most easily by matching the rise of the two signals) they are adjudged not to be caused by falling glass and the high-band energy corresponding to mid-band sound is not included in the integral.

The invention will be more clearly understood from the following description of preferred embodiments thereof in conjunction with the following drawings in which:

DETAILED DESCRIPTION OF PREFERRED EMBODIMENTS

Figure 1A:
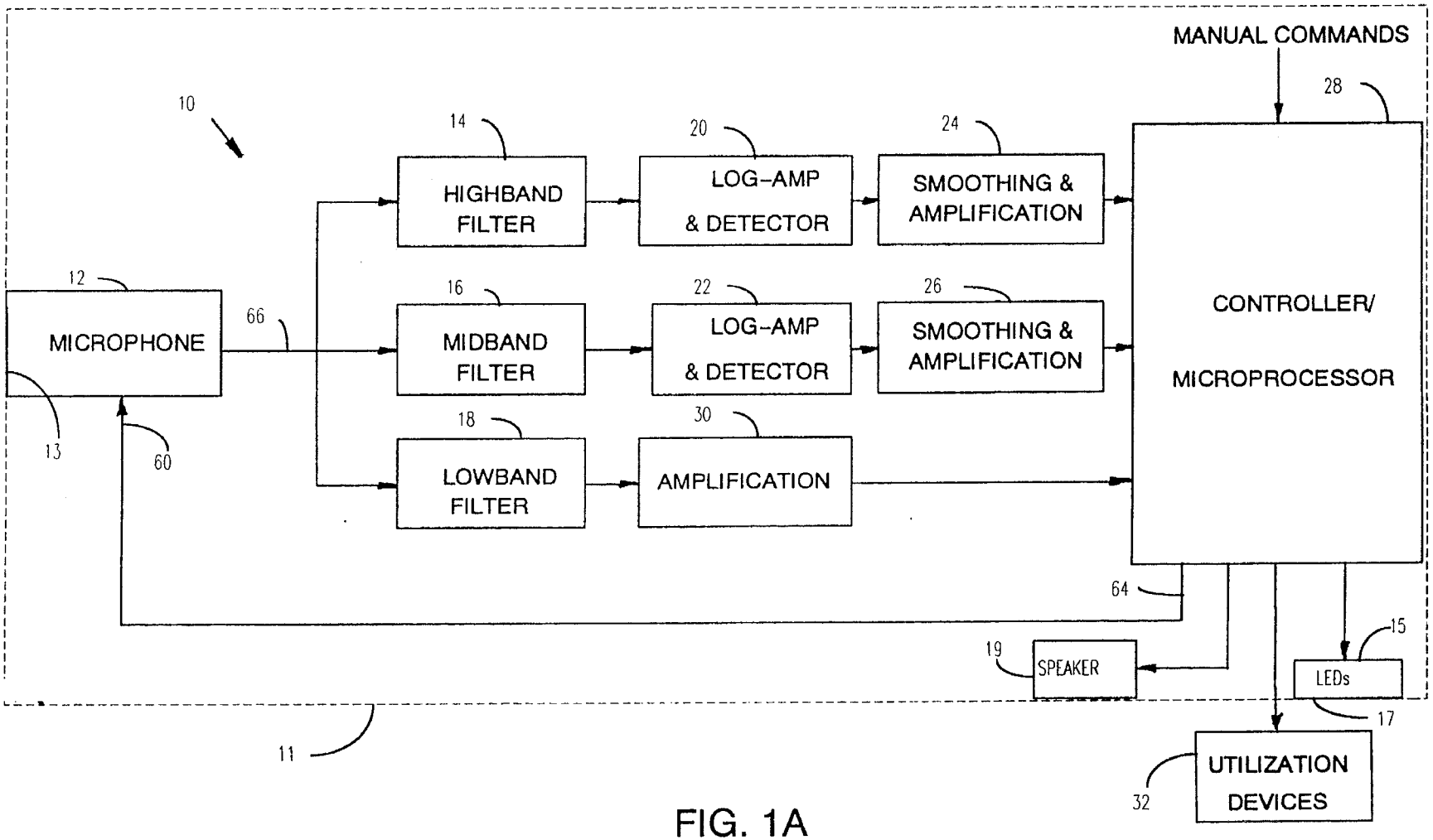
FIG. 1A is a block diagram of a glass breakage detector in accordance with a preferred embodiment of the invention.
Figure 1B:
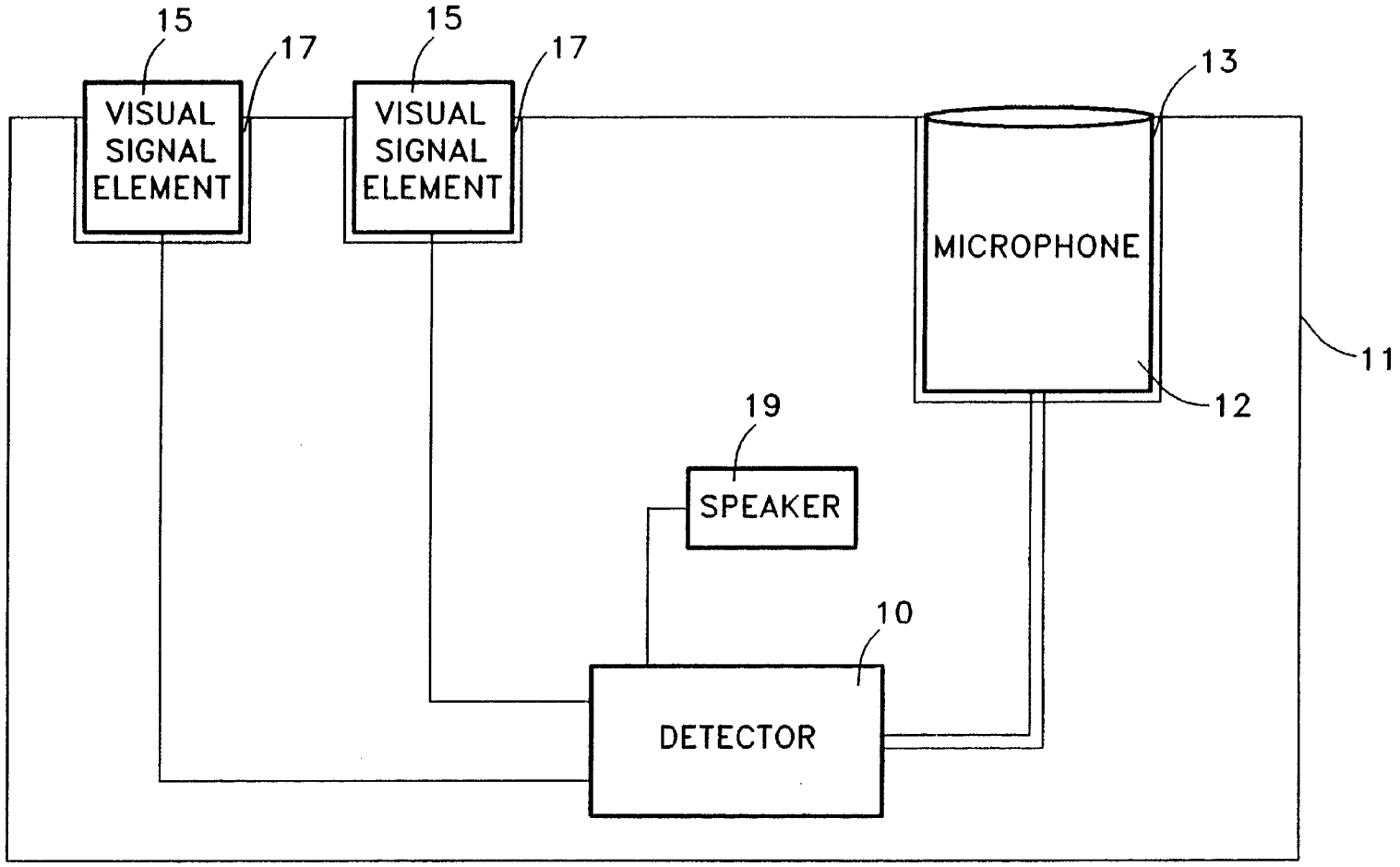
FIG. 1B is a simplified cross-sectional drawing of a glass breakage detector in accordance with a preferred embodiment of the invention.

FIG. 1 is a block diagram of a glass breakage detector 10 in accordance with a preferred embodiment of the invention. Detector 10 is preferably enclosed in a housing, shown schematically in FIG. 1A by dashed line 11 which may comprise a plastic case. Preferably, as shown in FIG. 1B, case 11 includes an opening 13 through which sound can reach a microphone 12. Case 11 may also have visual signal elements 15 mounted in mounting holes 17 in the case. Microphone 12 may be, for example, a type CMP-758 microphone manufactured by Boesung, Ltd. of Korea. When sound energy reaches microphone 12, an electrical signal is generated, which is fed to a triad of filters, namely, a high-band filter 14, a mid-band filter 16 and a low-band filter 18. In a preferred embodiment of the invention, high-band filter 14 has a center frequency of about 5.2 kHz and a bandwidth of about ±1 kHz; mid-band filter 16 has a center frequency of about 250 Hz and a bandwidth of about ±50 Hz; and low-band filter 18 has a center frequency of about 30 Hz and a bandwidth of about ±15 Hz.

High-band and mid-band filtered signals which are the results of the operation of high-band and mid-band filters 14 and 16 are separately fed to a pair of log- amplifiers/detectors 20 and 22 which amplify the signals while compressing the range of the amplified signals logarithmically and then envelope detect the amplified signal. The detected signals are further smoothed and amplified by a pair of smoothing/amplification circuits 24 or and 26 before being fed to respective inputs of a controller microprocessor 28 (hereinafter referred to as microprocessor 28 for simplicity) for further processing.

A low-band filtered signal which is the result of the operation of low-band filter 18 is amplified, preferably by a linear amplifier 30, before being fed to an input of microprocessor 28. The low-band signal is preferably digitally detected and filtered by microprocessor 28.

The three signals which are fed to microprocessor 28 are preferably sampled by the microprocessor so that microprocessor 28 may more easily process and analyze the signals. In one embodiment of the invention samples are taken every 0.25 milliseconds although most computations are based on samples spaced at 4 millisecond intervals. However, higher sampling and/or computation rates are believed to be useful if the controller/microprocessor is able to handle the data generated at the higher rates.

Microprocessor 28 first digitally smooths the signals in the three bands and then analyzes the signals by the method described below and sends a signal (generally, the closing of a switch) to one or more utilization devices 32 signaling that a glass breakage has occurred. Utilization devices 32 generally include at least one control center which receives signals from a number of detectors of one or more types and which activates one or more of an alarm bell, a buzzer, a speaker fed by an alarm signal, a computer at a remote location which receives an indication of a glass breakage, a telephone line which automatically dials a remote telephone, for example, a police telephone, or any other suitable indicator of glass breakage. Generally one or more LED mounted on case 11 is also activated. Microprocessor 28 also is used to activate a speaker 19 which is optionally present in the case during a test mode described below.

Detection apparatus 10 preferably compares a number of characteristics of one or more signals to predetermined criteria to determining if a glass breakage event has occurred. Some of the criteria involve characteristics of signals in all three frequency bands, some involve characteristics of signals in two bands and some involve only one band.

One type of criteria is used to reject sound patterns which are never associated with breaking glass. A second type is used to verify that the sound pattern is indeed a glass breakage effect and that no additional testing or analysis is required.

Some criteria comprise two ranges of values. If the signal characteristic meets a "tight" range, i.e., the signal characteristics are within a narrow range of values, the event is immediately identified as a glass breakage event. If the signal characteristics are within a wider range of values, the analysis continues to the next step. If the signal characteristics are outside the wider range, the event is identified as a nonbreakage event and is ignored and no further processing is performed.

Figure 2:
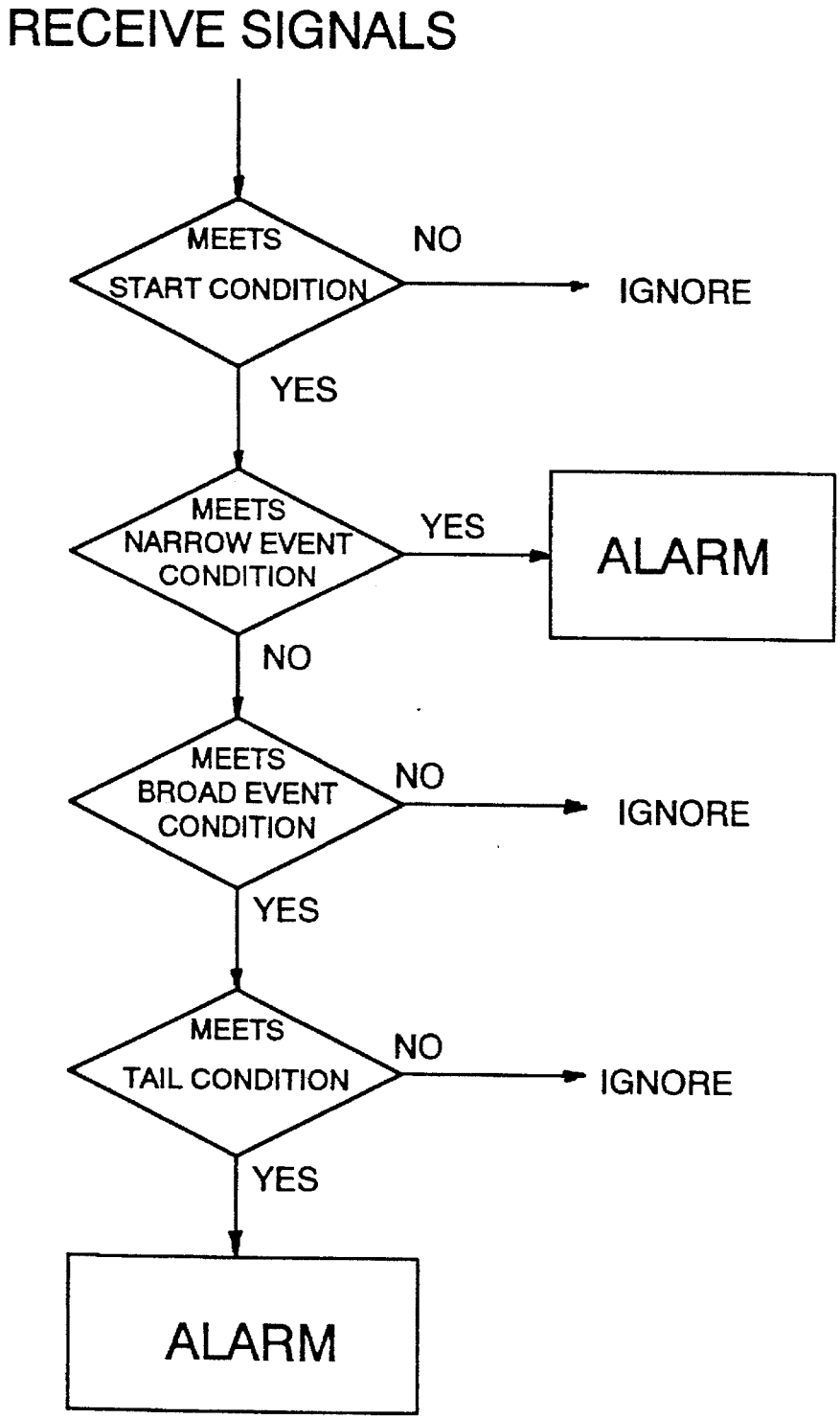
FIG. 2 is a flow chart of the process of determining if glass breakage has occurred according to a preferred embodiment of the invention.

Reference is made to FIG. 2 which shows a general overview of a preferred method of signal analysis of the present invention in flow diagram form.

The first step in the process is the determination whether an event which has occurred is potentially a glass breakage event. In order to make this determination, microprocessor 28 continuously computes the value of the normalized rate of rise of the signals in each of the three band signals and compares the computed value to a preset threshold. This comparison is given by the formula:

$$(dv/dt) \div v \geqq 125 \qquad (1)$$

for each of the three bands. In formula (1) dv/dt is the rate of change of the signal and v is the signal value at the time the rate of change is measured. In addition, the signals must have a predetermined minimum value so that noise does not activate the system.

In practice the rate of rise requirement translates (for a 4 millisecond time between samples) into the requirement that:

$$(\delta v/v) \geqq 0.5 \qquad (2)$$

where δv is the change in signal voltage between two successive samples.

The three signals need not meet the rate of rise (start of sequence) requirement simultaneously. The start requirement is considered met if the signals in all the bands meet the requirement within a 32 millisecond interval. This interval is used since it is one half the period of the low-band center frequency.

In a preferred embodiment of the invention, events for which the rate of rise criteria is met first by the low frequency signal is rejected as a non-glass breakage event. This situation is not characteristic of glass breakage, but rather of other events, such as a slamming door.

The next step in the process is to determine if the signals meet narrow and/or broad event criteria for a glass-breakage event. If the event meets the narrow event criteria, then the event is immediately identified as a glass breakage event and an alarm is sounded. If the signals fail to meet any of the broad event criteria, the event is ignored. If they meet the broad event criteria, microcomputer 28 checks if a tail criteria is met. If it is, the alarm is sounded; if not, the event is ignored.

The above-mentioned narrow and broad conditions are described in detail with reference to FIGS. 3A and 3B.

Figure 3A:
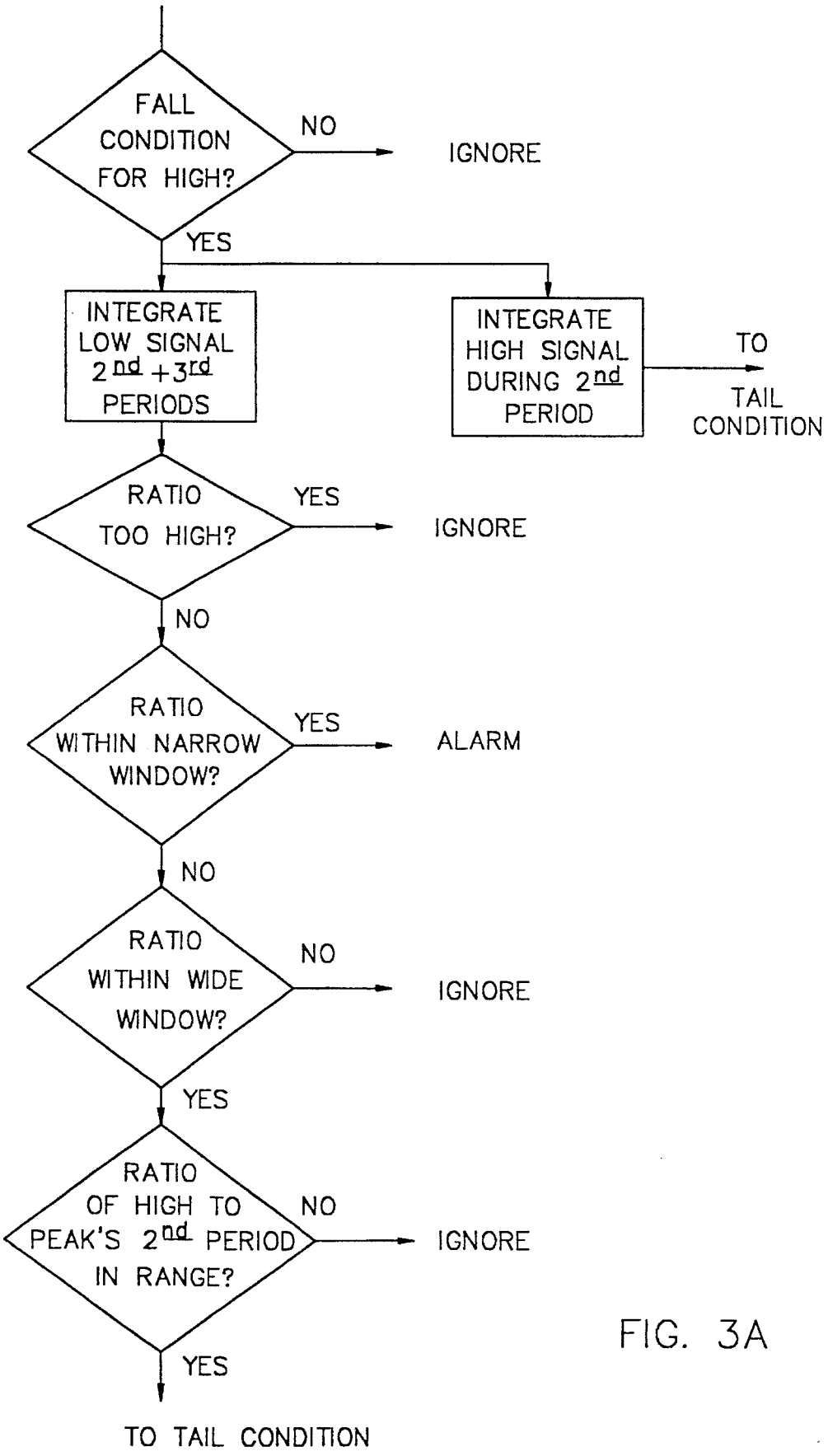
FIG. 3A and 3B are more detailed flow charts of portions of the chart of FIG. 2.
Figure 3B:
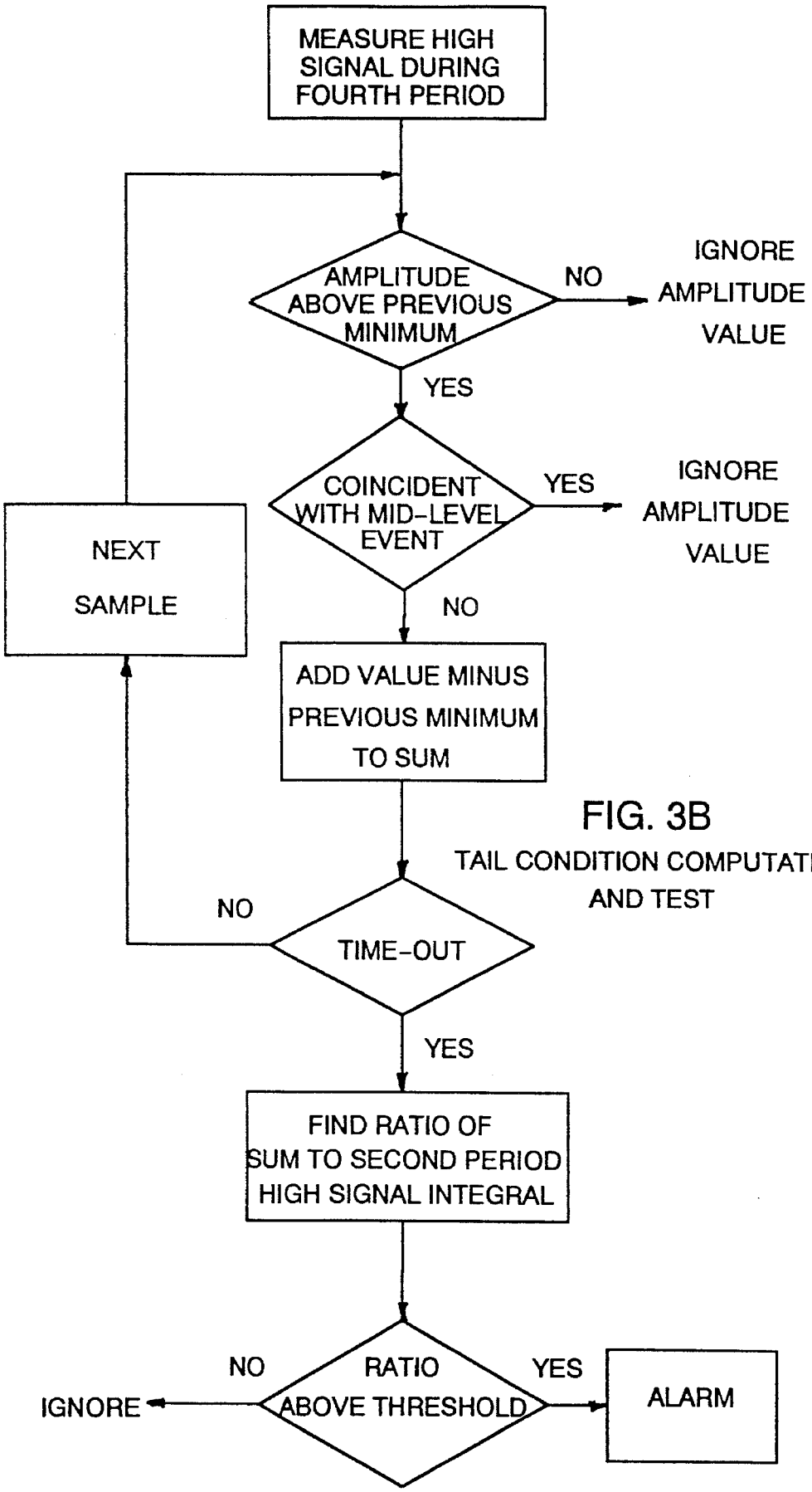

Reference is first made to FIG. 3A which shows the preferred methodology used to determine if the signals meet the various narrow and broad conditions.

In the preferred method of the invention, the time frame of the event is divided into a number of periods, starting at the fulfillment of the "start" condition (which is considered herein to comprise a first period). The next two periods are each preferably 128 milliseconds long. The fourth period starts 256 milliseconds after the start condition and ends 1024 milliseconds later. These periods have been found to work well; however, some variation of these periods is possible.

During the second period, the high and mid-band signals rise to a peak and begin to fall. If the signals fall too quickly, the event is immediately recognized as a non-breakage event and is ignored. While the rate of fall can be measured in a number of ways, the preferred method is to measure the ratio between the peak of the signal and its value at the end of the second period. In a preferred embodiment of the invention, signals which have a ratio of less than 4 are rejected although values as low as 2 can be used as exclusion ratios. A fall criteria may be required of both the high and mid band signals; however, it is generally sufficient for the high-band signal alone to meet the criteria.

During the second period, the high-band and low-band signals are preferably integrated and the result is stored. During the third period, the low-band signal is integrated and the result is compared with the low-band signal integral from the second period. If the integral from the third period is higher than that from the second period, this signifies that the glass has not broken but is vibrating. Thus, if the ratio of the third to second period integrals is greater than 1, the event is ignored.

Furthermore, if the ratio is less than 0.25, the event is also not a breakage event, but may be a hand-clap or other event. In this situation, the event is also ignored. If the ratio is between 0.25 and 1.0, the signal is further processed.

In practice the integrals are computed by simply summing the sampled values of the respective signals during the respective time period.

The amplitudes of the peak high-band and mid-band signals (which occur during the second period) are preferably compared. While the ratio of the two signals is dependent on the circuitry used, for the preferred embodiment of the invention shown in FIGS. 5A–5E, this ratio is required to be between 0.25 and 4.

If an event has meet the above criteria, i.e., it has been neither rejected or immediately accepted as a glass-breakage event, a tail condition criteria is applied to the signals to make a final determination.

In order to determine if the tail condition criteria has been met, the integral of the high-band signal during the fourth period is computed and compared with the integral of the high band signal during the second period. In order to meet the tail condition criteria, the integral in the fourth period must be above a given percentage of the integral in the second period.

The integral in the fourth period is computed in a different way from that in the second period. In essence, the method used in the fourth period integration attempts to isolate sounds caused by individual falling glass pieces or groups of pieces from other sounds which may be present. This is done in two ways.

Figure 4:
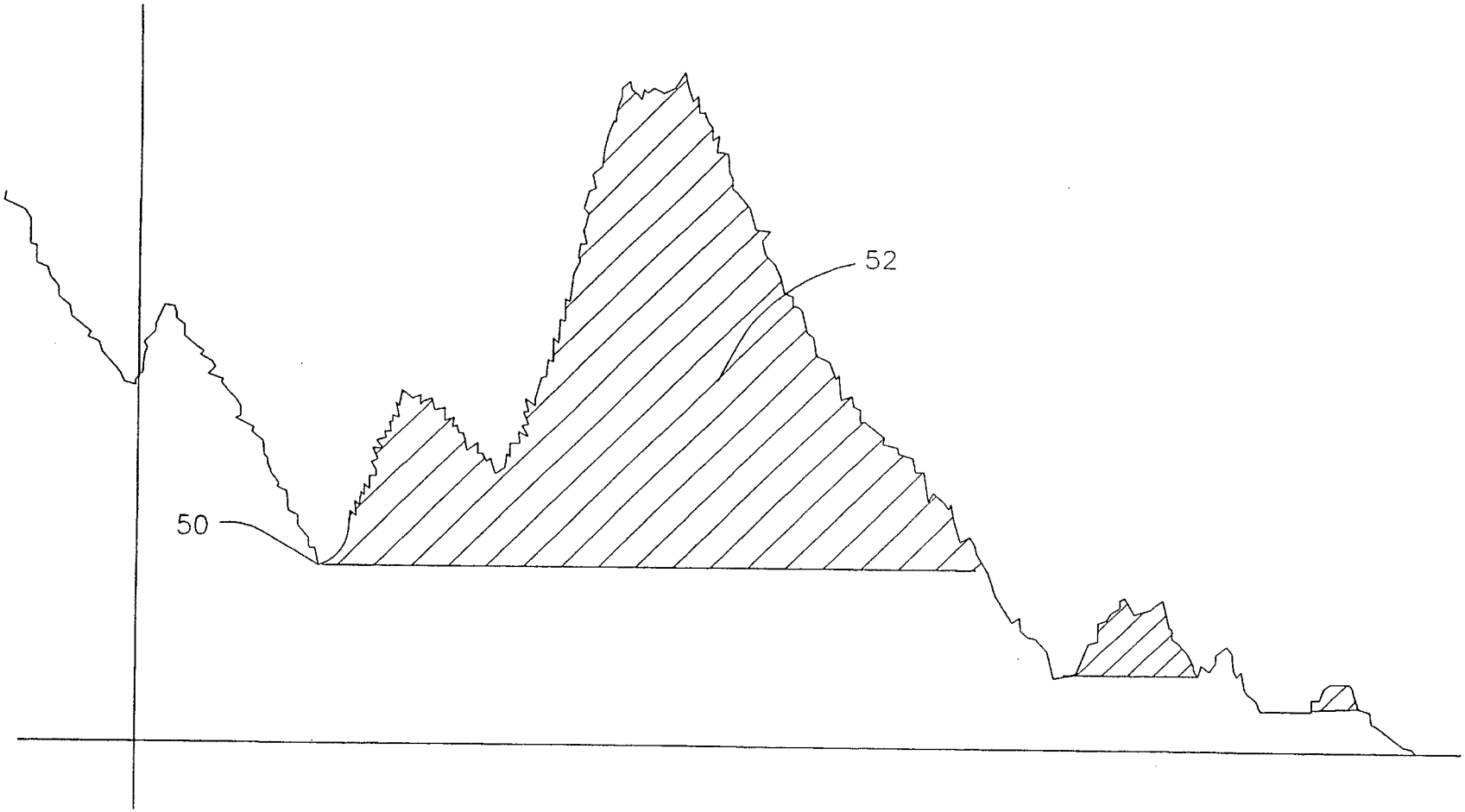
FIG. 4 shows a detail of the calculation of a tail signal integral.

First, the integral is taken only of those portions of the high-band signal which are above a threshold which is set by the previous minimum of the signal. This is best understood with reference to FIG. 4, which shows a portion of the high-band signal during the fourth period. The threshold level is set at a first minimum value 50 and during a following period the integral is taken of the value of the signal minus the threshold value. The integration continues so long as the signal is above the value at 50. In essence, this means that the integral is adjusted by subtracting the minimum value (at 50) times the integration time from it.

When the signal falls below threshold value 50 the signal is ignored so long as it continues to fall. When the signal reaches a new minimum and rises again, the new minimum becomes the threshold value for additional integration. In practice the integral is taken only of the area of the signal which is marked by reference number 52.

Second, high-band signals which occur at the same time as mid-band signals are not included in the integral. In practice, coincidence between the two signals is measured using the same rate of rise criteria as is used for the start condition, except that the coincidence time is reduced to 8 milliseconds. This time could be shortened if the sampling time were faster, since measurement shows that an actual coincidence time of only about 2 milliseconds is adequate to reject coincident signals. If the coincidence condition is met, the integral is not included until the next relative minimum is reached.

While a number of criteria have been described, it is possible to use only some of these criteria and in some embodiments of the invention it may be desirable to use fewer criteria.

FIGS. 5A–5E show actual circuitry used in a preferred embodiment of the invention. All of the amplifiers are preferably one-quarter of LM324 quad op-amps.

Figure 5A:
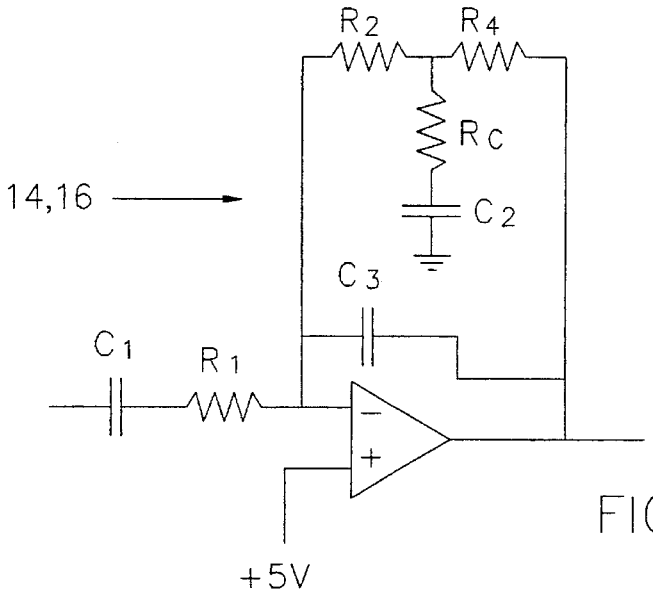
FIGS. 5A–5E show the electronic circuitry utilized in a preferred embodiment of the present invention.

FIG. 5A shows a preferred implementation of the high-band and mid-band filters 14 and 16. For the high-band filter, Cl=100pf, C2=47 nf, R1=1.5MΩ, R2=R4=100KΩ, R3=150Ωand C3 is omitted. For the mid-band filter, Cl=100pf, C2=47 nf, C3=15pf; R1=1.5MΩ, R2=R4=750KΩ, R3=1KΩ.

Figure 5B:
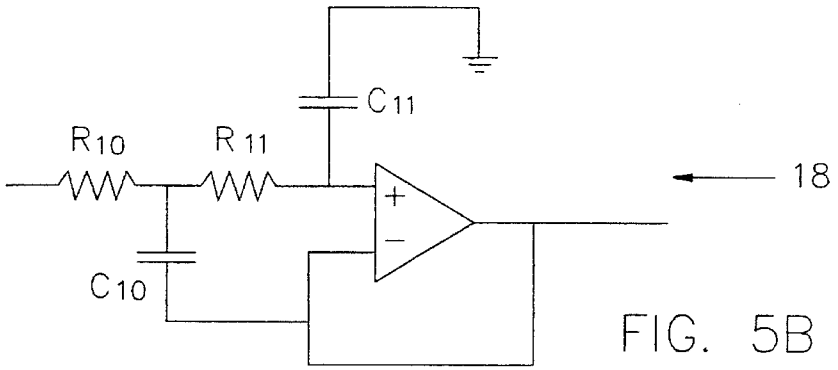

FIG. 5B shows a preferred implementation of low-band filter 18 where R10=R11=82KΩ, C10=C11=47 nf.

Figure 5C:
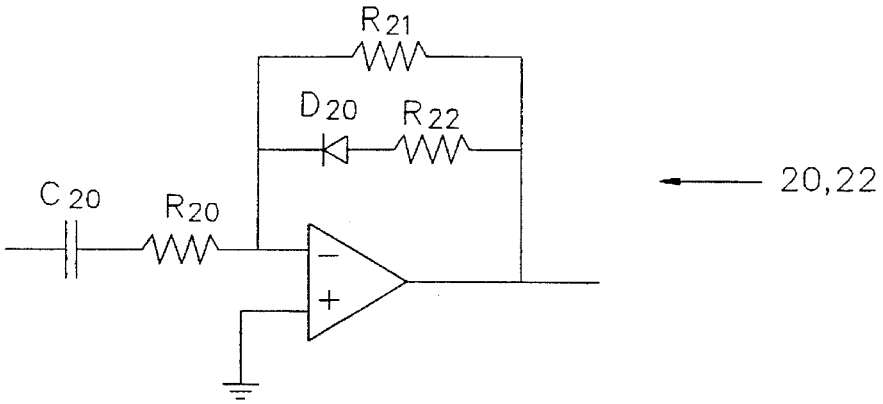

FIG. 5C shows a preferred implementation of log amplifiers/detectors 20 and 22 (which are identical) where C20=47 nf, R20=4.7KΩ, R21=150KΩ, R22=27KΩand D20 is a 1N4148 diode.

Figure 5D:
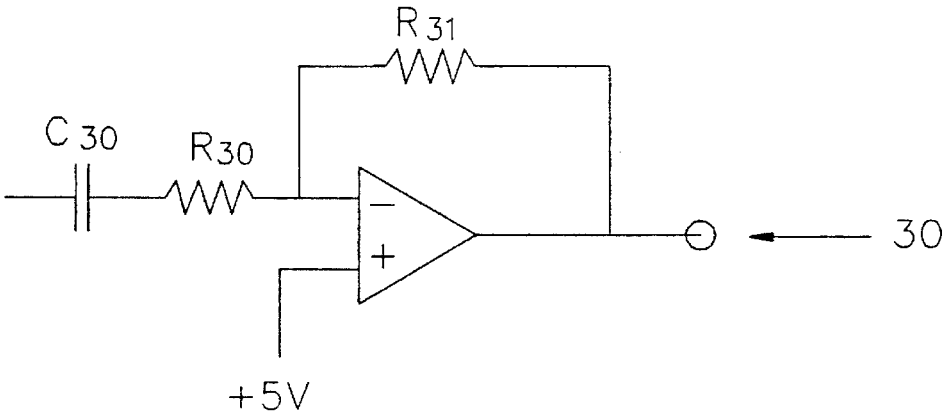

FIG. 5D shows a preferred implementation of amplifier 30 where C30=47 nf, R30=39KΩ, R31=3.3MΩ.

Figure 5E:
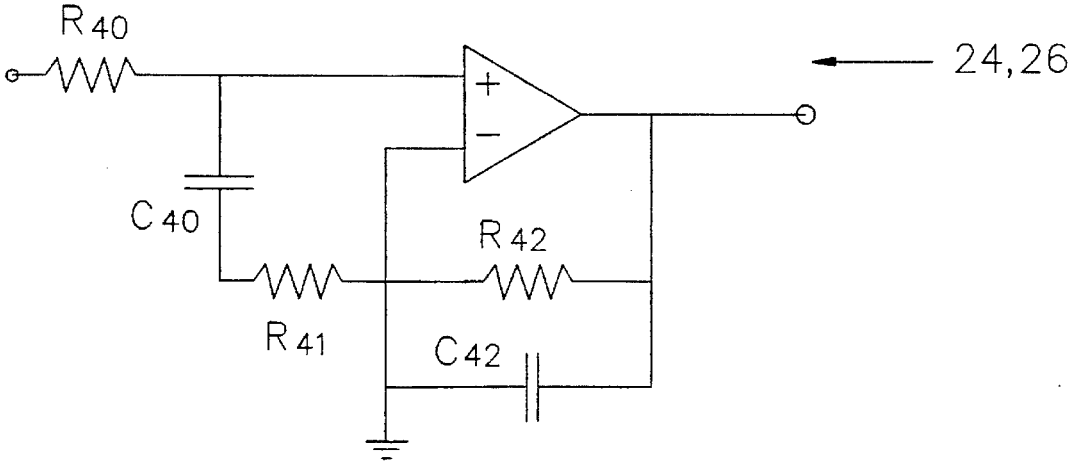

FIG. 5E shows a preferred implementation of smoothing/amplification circuits 24 and 26 (which are identical) where R40=R41=20KΩ, C40=C42=22 nf, R42=1MΩ.

In a practical implementation of the invention, controller/microprocessor 28 is a PIC16C71 microcontroller. It may, however, be advantageous to use a more powerful microprocessor in some implementations of the invention.

In a preferred embodiment of the invention, the circuitry of detector 10 may be easily checked when a speaker is included as one of utilization devices 32. Referring to FIG. 1, microprocessor 28 instructs the speaker to emit swept frequency (or a sequence of single frequency) sounds. These sounds, which may be of a low level, are detected by microphone 12 and processed by electronic circuitry within blocks 20–26 before being fed to microprocessor 28. Microprocessor 28 checks the level of the received signals against the commands which it sent to the speaker and, based on these values, determines if the microphone, amplifiers and filters are operating correctly. If signals at a second sound level are also produced, the log-amplification can also be checked.

If the detector determines that one or more portions of the circuitry is inoperative, either a warning light is flashed or an indication is sent to the control center or a remote watch station. A buzzer in the detector may be activated as a further indication.

In an alternative, especially preferred, embodiment of the invention, the circuitry shown in FIG. 1 is used to feed the swept or sequential signals to the detection circuitry via the microphone. In this embodiment, one terminal 60 of microphone 12 is connected to an output 64 of microprocessor 28 and another terminal 66 of microphone 12 is connected to the high, mid and low-band filters. In normal operation, output 64 is grounded and the detector operates in the normal manner described above. In a test mode, the swept or sequential signals are fed to terminal 60 of microphone 12 and pass through the microphone (with a known attenuation) to the other terminal. The amplitude of the signals fed to microprocessor 28 via the electronics contained in the blocks of FIG. 1 is measured by microprocessor 28 to determine if the electronics are operating properly.

In a further preferred embodiment of the invention, the self-test procedure can include a check on whether the detector has been disabled by covering opening 13 in housing 11. This condition can be easily distinguished by checking the sound level detected by the microphone of a sound signal emitted by the speaker 19. A detected level substantially different from a reference level is an indication that openings in the cover have been covered in an attempt to disable the detector.

It will be appreciated by persons skilled in the art that the present invention is not limited by what has been particularly shown and described herein. Rather, the scope of the present invention is defined only by the claims which follow:

We claim:

1. A method of analyzing a sound produced by an event to determine if the event is a glass breaking event comprising:

sensing the sound and producing an electrical sound signal characteristic of the sound;

producing a plurality of frequency band-limited signals from the sound signal;

determining when a normalized rate-of-rise of at least two of the plurality of the band limited signals is above a given value specified for the particular band-limited signal, each of said normalized signals being normalized to the peak value of said respective signal; and identifying whether said event is to be further analyzed to determine whether its sound is characteristic of a glass breakage event only if said at least two of the plurality of the band-limited signals have a normalized rate-of-rise greater than their respective given value during a specified time period.

2. A method according to claim 1 wherein producing a plurality of signals comprises producing three band-limited signals, and the step of determining comprises finding whether the normalized rates-of-rise of each of said three band-limited signals are above their respective given values for at least some time during a given time period.

3. A method according to claim 1 wherein the event is determined to be a non-breakage of glass event if the normalized rate of rise of the signal of the at least two band limited signals having the lowest frequency of said signals is above its respective given value at a time before another of the at least two band-limited signals rises above its given value.

4. A method according to claim 1 further comprising comparing the peak values of said at least two of the plurality of the band-limited signals prior to identifying an event to be further analyzed wherein said identifying includes determining that an event be further analyzed only if the ratio of the peak values of said at least two of the band limited signals is within a specified range.

5. A method according to claim 1 wherein the step of identifying comprises the step of comparing at least one characteristic value derived from the band-limited signals with a relatively narrow range of values and a relatively wide range of values, wherein an event is characterized as a glass-breakage event if the characteristic value is within the relatively narrow range of values, is rejected as a non-glass breakage event if the characteristic value is outside the relatively wide range of values and is identified as an event to be further analyzed to determine whether the sound is characteristic of a glass breakage event if the characteristic value is within the relatively wide range of values but outside the relatively narrow range of values.

6. A method according to claim 1 wherein:

producing a plurality of band limited signals includes producing a band-limited signal having a high frequency range characteristic of falling glass and a lower band-limited signal which is not characteristic of falling glass; and identifying the event includes integrating the high frequency band-limited signal to form an integral signal, during at least a portion of a time period in which sound characteristic of falling glass from a breakage event is expected to occur, said at least portion of the time period not including time periods during which the high frequency band-limited signal is coincident with the signal from lower frequency band.

7. A method of analyzing a sound produced by an event comprising:

sensing the sound and producing an electrical sound signal characteristic of the sound;

producing a plurality of frequency band-limited signals from the electrical signal; and characterizing the event by comparing at least one characteristic value derived from the band-limited signals with a first range of values and with a second range of values, said second range of values being wider than said first range of values wherein the event is characterized as a glass-breakage event if the characteristic value is within the first range of values, is characterized as a non-glass breakage event if the characteristic value is outside the second range of values and is characterized as an event which is to be further analyzed to determine whether a glass breakage event has occurred if the characteristic value is within the second range of values but outside the first range of value.

8. A method according to claim 7 wherein the further analysis to determine whether a glass breakage has occurred comprises comparing the sound to a sound which is characteristic of falling glass.

9. A method of determining whether a sound is generated by falling glass comprising sensing the sound and producing an electrical signal characteristic of the sound;

producing a plurality of frequency band-limited signals from the electrical signal including at least one band-limited signal having a high frequency range characteristic of falling glass and one lower band-limited signal which is not characteristic of falling glass; and integrating the high frequency band-limited signal to form an integral signal during at least a portion of a time period during which sound characteristic of falling glass in a glass breakage event is expected to occur, and comparing the integral signal with a threshold value to identify whether a glass breakage event has occurred.

10. A method according to claim 9 wherein the value of the integral is reduced by the product of a previous minimum of the high-frequency band-limited signal times the integration time.

11. A method according to claim 9 wherein the threshold value is derived from an integral of the high frequency band-limited signal computed over an earlier period of time, said earlier period of time also comprising a time period during which a sound characteristic of falling glass from a glass breakage event is expected to occur.

12. A method according to claim 9, wherein said portion of a time period during which integration occurs does not include time periods during which the high frequency band-limited signal is coincident with the signal from a lower frequency band.

13. A method according to claim 10, wherein said portion of a time period during which integration occurs does not include time periods during which the high frequency band-limited signal is coincident with the signal from a lower frequency band.

14. Apparatus for analyzing a sound produced by an event comprising:

a sensor which senses the sound and produces an electrical signal characteristic of the sound;

means for producing a plurality of frequency band-limited signals from the sound signal;

rate-of-rise determining circuitry which receives the band limited signals and determines when a normalized rate-of-rise of at least two of the plurality of the band limited signals is above a respective given value specified for the particular band-limited signal; and a signal analysis system which identifies the signal as a signal which is to be further analyzed to determine whether glass breakage has occurred, said signal analysis system analyzing the electrical signal further only if a plurality of the band-limited signals have a normalized rate-of-rise greater than their respective given value during a predetermined time period.

15. Apparatus according to claim 14 wherein the means for producing a plurality of signals is operative to produce three band-limited signals, the normalized rates-of-rise of each of which must be above a specified predetermined value during at least part of a predetermined time period in order for the electrical signal to be analyzed further.

16. Apparatus according to claim 14 wherein the signal is not processed further if the normalized rate-of-rise of the lowest band signal of the plurality of band-limited signals is above its given value before another one of the plurality of band-limited signals.

17. Apparatus according to claim 14 further comprising:

means for comparing the peak values of two of the band limited signals wherein the event is identified as a non-glass breakage event if the ratio of the peak values is outside a specified range.

18. Apparatus according to claim 14 wherein the signal analysis system includes comparator circuitry which further analyzes the electrical signal to determine whether a glass breakage event has occurred by comparing at least one characteristic value derived from the band-limited signals with a first range of values and a second range of values, wherein an event is characterized as a glass-breakage event if the characteristic value is within the first range of values, is rejected as a non-glass breakage event if the characteristic value is outside the second range of values and further analysis of the signals is performed if the characteristic value is within the second range of values but outside the first range of values.

19. Apparatus according to claim 18 wherein the further analysis circuitry comprises circuitry which determines a characteristic value of the sound of the event and compares the characteristic value with a value which is characteristic of falling glass.

20. Apparatus according to claim 14 wherein:

the means for producing includes means for producing at least one band-limited signal having a high frequency range characteristic of falling glass and a lower band-limited signal which is not characteristic of falling glass; and the analysis circuitry includes an integrator which integrates the high frequency band-limited signal during a time period characteristic of falling glass from a breakage event only if it is not coincident with the signal from the lower frequency band.

21. Apparatus for detecting glass breakage utilizing the sound produced by an event comprising:

a sensor which senses the sound and produces an electrical signal characteristic of the sound;

means for producing a plurality of frequency band-limited signals from the electrical signal; and analysis circuitry which receives the band-limited signals and compares at least one characteristic value of the band-limited signals with a first range of values and a second range of values, said second range of values being wider than said first range of values, wherein an event is characterized as a glass-breakage event if the characteristic value is within the first range of values, is rejected as a non-glass breakage event if the characteristic value is outside the second range of values and the signals are passed to further analysis circuitry which further analyzes the signals to determine if the sound was caused by a glass breakage event.

22. Apparatus for analyzing sound to determine a breakage of glass comprising:

a sensor which senses the sound and produces an electrical signal characteristic of the sound;

means for producing a plurality of frequency band-limited signals from the sound signal including at least one band-limited signal having a high frequency range characteristic of falling glass and one lower band-limited signal which is not characteristic of falling glass; and analysis circuitry including an integrator which integrates the high frequency band-limited signal to form an integral signal during at least a portion of a time period during which sound characteristic of falling glass in a breakage event is expected to occur, said at least portion not including time periods during which the high frequency band limited signal is coincident with a signal from lower frequency band and comparing the integral signal to a threshold value.

23. Apparatus according to claim 22 wherein the integral is reduced by product of a previous minimum of the high-frequency band-limited signal times at least a portion of the integration time.

24. Apparatus according to claim 22 wherein the threshold value is derived from the integral of the high frequency band-limited signal computed over an earlier period of time, said earlier period of time also comprising a time period during which a sound characteristic of falling glass from a glass breakage event is expected to occur.

* * * * *